United States Patent [19]

Naka

[11] Patent Number: 4,843,789

[45] Date of Patent: Jul. 4, 1989

[54] CEILING CONSTRUCTION

[75] Inventor: Hiromitsu Naka, Yashio, Japan

[73] Assignee: Kabushiki Kaisha Naka Gijutsu Kenkyusho, Tokyo, Japan

[21] Appl. No.: 515,264

[22] Filed: Jul. 19, 1983

[30] Foreign Application Priority Data

Jul. 11, 1982 [JP] Japan ..... 57-127258

[51] Int. Cl.[4] ..... E06B 3/00

[52] U.S. Cl. ..... 52/208; 52/204

[58] Field of Search ..... 52/205, 208, 213, 214, 52/656, 196, 489, 488, 669, 665, 28, 210, 204; 98/40 DL, 40 D

[56] References Cited

U.S. PATENT DOCUMENTS

| | | | |
|---|---|---|---|
| 2,822,584 | 2/1958 | Urbain | 52/488 |
| 2,913,571 | 11/1959 | Smith | 98/40 DL |
| 3,121,259 | 2/1964 | Versen | 52/28 |
| 3,397,499 | 8/1968 | Ward | 52/665 |
| 3,743,826 | 7/1973 | Halfaker | 98/40 DL |
| 4,103,948 | 8/1978 | Naka | 292/258 X |
| 4,139,972 | 2/1979 | Naka | 52/208 |
| 4,443,973 | 4/1984 | Naka | 49/395 |

FOREIGN PATENT DOCUMENTS

| | | | |
|---|---|---|---|
| 2719296 | 11/1977 | Fed. Rep. of Germany | 52/488 |
| 1352258 | 12/1964 | France | 52/200 |

*Primary Examiner*—John E. Murtagh
*Assistant Examiner*—Anthony W. Williams
*Attorney, Agent, or Firm*—Wenderoth, Lind & Ponack

[57] ABSTRACT

A ceiling construction for buildings has a plurality of flanged main beams disposed in a predetermined spaced relationship to each other and bridging wall mouldings opposed and spaced from each other; a plurality of flanged cross beams connected to the main beams in a predetermined spaced relationship to each other at right angles on the main beams so as to form a ceiling framework; a ceiling wall mounted to the ceiling framework so as to form an access opening in a predetermined position; a pair of auxiliary beams; an access door; and a plurality of mounting devices for the access door. The pair of auxiliary beams each is bridged in a predetermined relationship to the opposite main beams of the main beams adjacent to and spaced from each other or the opposite cross beams of the cross beams adjacent to and spaced from each other on the inner side of the ceiling wall in relation to the access opening. Further, the access door is positioned in the access opening, and is secured to the ceiling framework by the use of the auxiliary beams and mounting devices.

3 Claims, 6 Drawing Sheets

CEILING CONSTRUCTION

BACKGROUND OF THE INVENTION

This invention relates to a ceiling construction for buildings and more particularly, to an improved ceiling construction having the ceiling framework which comprises a plurality of main beams and a plurality of cross beams.

Within recent years, ceiling constructions erected by the exposed, concealed and dry wall construction methods have been popularized.

The ceiling framework of the ceiling construction erected by any one of the three known construction methods comprises a grid system which comprises a plurality of flanged main beams and a plurality of flanged cross beams interconnected at right angles to each other to form a grid formation. In the ceiling construction erected by the exposed construction method, the ceiling boards which constitute the ceiling wall are fitted in the grid and laid on the flanges on the main and cross beams in the grid. In the ceiling construction erected by the concealed construction method, the ceiling boards which constitute the ceiling wall are positioned in the grid with the flanges on the main beams received in the grooves formed in the end faces of the ceiling boards. In the ceiling construction erected by the dry wall construction method, the ceiling boards which constitute the ceiling wall are secured to the main and cross beams by means of nails or screws in the grid. The ceiling construction usually includes an access door, but in the ceiling construction erected by the exposed construction method, since the ceiling boards can be easily removed, such a ceiling construction is not provided with the access door. In the ceiling construction erected by the concealed construction method, the ceiling boards are mounted on the main beams by the employment of access angles and hooks in suitable positions on the ceiling whereby the ceiling boards can be removed and thus, as in the case of the ceiling construction erected by the exposed construction method, in the ceiling construction erected by the concealed construction method, the access door is not usually employed. However, when the ceiling boards are designed to be removed, as the ceiling boards are removed and reinstated, the ceiling boards tend to be damaged or smeared leading to an undesirable result.

In the ceiling construction erected by the dry wall construction method, since the ceiling boards are not detachable, the access door is disposed in the access opening formed in a suitable position of the ceiling surface. In such a case, taking the weight of the access door into consideration, the access door is attached to the frame channel bound to hanger wires secured to the ceiling slabs by wire fasteners or attached to the frame channel bound to the main beams. In such an access door mounting arrangement, the construction method of the ceiling construction is very troublesome. Especially, when the frame channel is directly hung from the ceiling slabs and the access door is attached to the frame channel, after a prolonged use of the ceiling construction, an undesirable step is formed between the access door and ceiling wall.

SUMMARY OF THE INVENTION

Therefore, one object of the present invention is to provide a ceiling construction for buildings which can be easily erected by the exposed, concealed or dry wall construction method.

Another object of the present invention is to provide a ceiling construction for buildings which is reinforced and is prevented from warping both in the horizontal and vertical directions under the load of the access door as the access door is opened and closed, and which prevents any strain or deflection in the grids of the ceiling construction.

A further object of the present invention is to provide a ceiling construction for buildings which allows the access door to open and close smoothly, which can be easily and simply constructed in a brief period and which has an improved finish.

For attaining the above objects, the present invention provides a ceiling construction for buildings which comprises a plurality of flanged main beams disposed in a predetermined spaced relationship to each other and bridging wall mouldings opposed and spaced to each other;

a plurality of flanged cross beam connected to said main beams in a predetermined spaced relationship to each other at right angles to the main beams so as to form a ceiling framework;

a ceiling wall mounted on said ceiling framework so as to form an access opening in a predetermined position;

a pair of auxiliary beams each bridging in a predetermined relationship the opposite main beams of said main beams adjacent to and spaced from each other or the opposite cross beams of said cross beams adjacent to and spaced to each other on the inner side of said ceiling wall in relation from the access opening;

an access door positioned in said access opening and comprising a stationary framework having an outwardly extending flange, a movable framework rotatably connected to said stationary framework and a cover plate fixedly secured to said movable framework; and a plurality of mounting means securing said access door to said ceiling framework so as to put one of the peripheral edges of said access opening and the adjacent flanges of said main and cross beams between said auxiliary beams and said outwardly extending flanges on the stationary framework.

The advantages offered by the invention are mainly that the exposed, concealed and dry wall construction methods can be easily selectively applied as desired, the ceiling where the ceiling construction is erected is reinforced and reduced in weight, that even if the weight of the ceiling is reduced the ceiling can be prevented from warping in the horizontal and vertical directions under the load imposed on the ceiling by the access door as the access door is opened and closed, that the ceiling is free from any deflection or strain caused in the grids of the ceiling framework and that especially, when the access door is suddenly opened and closed any flapping phenomenon or vibration of the ceiling under the load of the access door is prevented. Therefore, the ceiling construction for buildings which has the above-mentioned arrangement of the components is of practical use.

Thus, since the present invention provides positive reinforcing means for mounting the access door, the construction of the ceiling by the exposed, concealed and dry wall construction methods is further enhanced and the ceiling construction of the invention is advantageously applicable to the ceilings of various buildings and more particularly, to building ceilings of large dimensions.

BRIEF DESCRIPTION OF THE DRAWINGS

The aforementioned and other objects and attendant advantages of the present invention will be more readily apparent to those skilled in the art from the following description when read in connection with the accompanying drawings, in which.

DETAILED DESCRIPTION OF THE INVENTION

Figure 1:
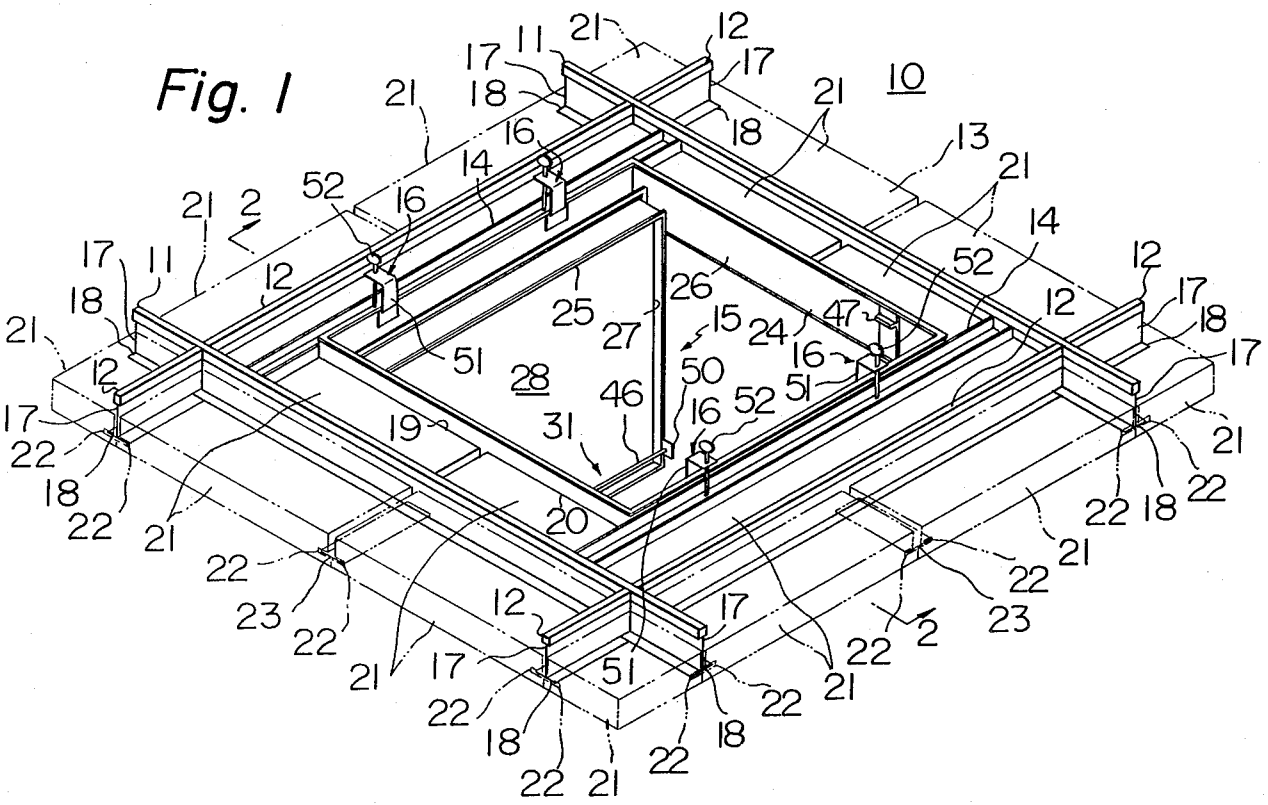
FIG. 1 a fragmentary perspective view of a first embodiment of the ceiling construction of the invention erected by the concealed construction method as applied to a building.
Figure 2:
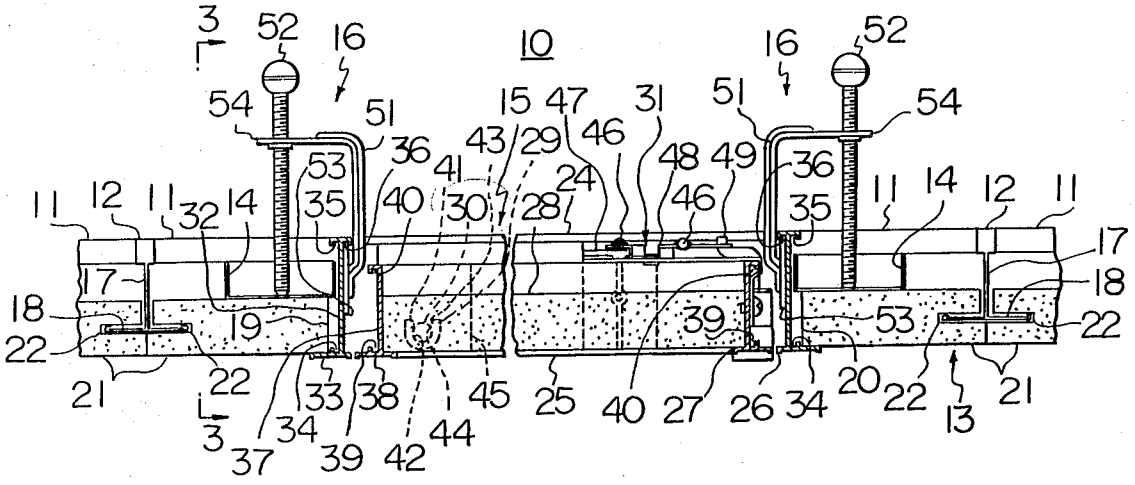
FIG. 2 is a cross-sectional view taken along substantially the line 2—2 of FIG. 1.
Figure 3:
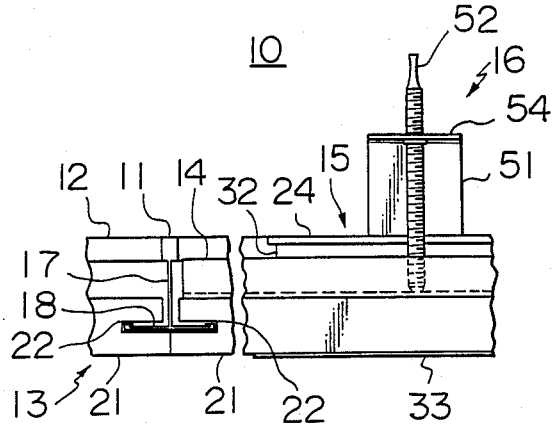
FIG. 3 is a cross-sectional view taken along substantially the line 3—3 of FIG. 2.

The present invention will be now described referring to the accompanying drawings and more particularly, to FIGS. 1 through 3 thereof in which the first embodiment of the ceiling construction of the invention as applied to a building is fragmentarily shown.

The illustrated ceiling construction 10 is erected by the concealed construction method and includes a plurality of flanged main beams 11 bridging in a predetermined spaced relationship opposing wall mouldings (not shown) secured to the ceiling wall of a building in a square arrangement and hung in suitably spaced positions on the ceiling slabs by means of hanger wires or hanger rods (not shown), a plurality of cross beams 12 extending between the main beams 11 and connected to the main beams 11 in a predetermined spaced relationship and also extending between and connected to the main beams and the associated wall mouldings at right angles thereto so as to form a ceiling framework, a ceiling wall 13 mounted on the ceiling framework so as to define an access opening 19 in a predetermined position or a selected grid of the ceiling framework, a pair of auxiliary beams 14 bridging in a predetermined spaced relationship the flanges 18 on one pair of opposing ones of the main beams 11, an access door 15 positioned in the access opening 19 and four mounting means 16 securing the access door 15 to the ceiling framework so as to sandwich the access opening defining edge 20 of the ceiling wall 13 between auxiliary beams 14 and access door 15.

The main beam 11 is formed by rolling a length of metal band such as band steel, aluminum alloy or stainless steel having a T-shaped cross section and has end couplings (not shown) at the opposite ends. A number of such rolled metal bands are connected end to end and are connected in a suitable length depending upon the dimensions of the ceiling of the building.

The cross beam 12 is also formed by rolling a length of metal band such as band steel, aluminum alloy or stainless steel having T-shaped cross section as in the case of the main beam 11. The length of the cross beam 12 is selected depending upon the span between the opposing main beams 11 and between the main beam 11 and the adjacent wall moulding, respectively. The cross beam 12 has twisted clips or hook clips (not shown) at the opposite ends so that the cross beam 12 may be connected to the associated main beam or beams 11 and wall moulding.

The ceiling wall 13 is formed of a number of ceiling tiles 21 processed to a predetermined dimension and assembled to the ceiling framework. The ceiling tile 21 has cut grooves 22 on the opposite side faces and at the opposite end faces for receiving the flanges 18 of the main and cross beams 11, 12. Ribbed splines 23 are inserted into between the groove 22 in the abutting side faces of the adjacent ceiling tiles 21 and the flanges 18 of the cross beams 12 are cut away in the grid of the ceiling framework into which the ceiling tiles 21 are finally incorporated and thus closing splines (not shown) are inserted into the grooves 22 to be hooked to the cross beams whereby the ceiling tiles 21 are assembled to the ceiling framework.

The type of the ceiling tile 21 is, of course, selected depending upon the specification of the ceiling structure of the invention and the ceiling tile may be replaced by a cement board having heat-resisting fiber mixed therewith, wood board or board having sound absorption material mixed therewith, for example.

Each of the pair of auxiliary beams 14 is formed of I-shaped cross-section steel having a length corresponding to the span between the opposing main beams 11. However, the auxiliary beam 14 may be, of course, formed by rolling a band steel of suitable length.

The access door 15 is fitted in the access opening 19 and includes a stationary framework 24 secured to the ceiling framework by the mounting means 16 which cooperate with the ceiling wall 13 and auxiliary beams 14 in securing the access door 15 to the ceiling framework, a movable framework 25 disposed within the opening 26 defined by the stationary framework 24 for rotational movement relative to the stationary framework 24, a cover plate 28 fixedly secured to the movable framework 25 by mean of securing means (not shown) to normally close the opening 27 defined by the stationary framework 25, a pair of bearings 29 projecting inwardly from the opposing inner surfaces of the stationary framework 24 (the left and right-hand surfaces as seen in FIG. 1), a pair of shafts 30 projecting outwardly from the opposite sides of the stationary framework 25 (the left and right-hand sides as seen in FIG. and journaled in the bearings 29 for rotation therein, and a cremorne lock 31, whereby when the movable framework and cover plate assembly 25, 28 and more particularly, the cover plate 28 is its closed position, the movable framework and cover plate assembly is locked to the stationary framework 24 by the cremorne lock 31 and when the cremorne lock 31 is unlocked, the movable framework and cover plate assembly 25, 28 is allowed to rotate downwardly to open the opening 27.

The stationary framework 24 is formed by assembling four extruded aluminum alloy frame members cut to a predetermined length in a square arrangement. More particularly, each of the four aluminum alloy frame members of the stationary framework 24 includes a frame web 32 and a flange 33 integrally formed with the lower end of the web 32 and extending outwardly in the opposite directions at right angles thereto to define the opening 26 in cooperation with the web. The frame web 32 and flange 33 form a lower groove 34 and upper grooves 35, 36. The stationary framework 24 also includes four corner pieces formed of steel plate in addition to the four aluminum alloy frame members each comprising the web an flange which forms lower and upper grooves in cooperation with the web.

Similarly, the movable framework 25 is formed by assembling four aluminum alloy frame members cut to a predetermined length in a square arrangement. More particularly, each of the four aluminum alloy frame members includes a frame web 37 and a flange 38 integrally formed with the lower end of the frame web 37 and extending outwardly therefrom in the opposite direction at right angles thereto to define lower and upper grooves 39, 40 in cooperation with the frame web. The movable framework 25 also includes four corner pieces formed of steel in addition to the four aluminum alloy frame members each comprising the web and flange which forms the lower and upper grooves in cooperation with the web.

The cover plate 28 is formed of some of the ceiling tiles 21 and rides on the inside of the outwardly extending flanges 38. The cover plate 28 is fixedly secured to the movable framework 25 by means of a plurality of fasteners and screws.

The pair of bearings 29 each has a bearing groove 41 with a substantially U-shaped bearing face 42 and a pair of inward bulges 44, 44 are formed on the bearing face 42 in the upper opening 43 of the bearing groove 41.

Since the bearing 29 has the bearing groove 41 having the inward bulges 44 formed on the bearing face 42, the upper opening 43 of the bearing groove 41 is constructed so that the shaft 30 can be snapped into and out of the bearing groove 41.

The bearing 29 further has a plate-like bracket 45 integrally formed with one end thereof to be attached to the stationary framework 24 whereas the other end of the bearing 29 is positioned adjacent to the adjacent frame web 37 of the movable framework 25 with the lower portion of the other end serving as a stop for the adjacent outwardly extending flange 38 of the movable framework 25 and the end face of the other end serving as an anti-rocking means for the movable framework 25.

The bearing 29 having the bracket 45 as its integral part is formed of polyamide resin or fluorinated resin, but can be also formed of bearing alloy.

Each of the pair of shafts 30 is formed at one end with a reduced outer diameter sleeve and the sleeve is passed through the pin hole in one of the corner pieces associated with the movable framework 25 and the leading end of the sleeve is caulked against the corner piece to thereby secure the shaft 30 to the movable framework 25.

Thus, when the movable framework 25 is formed by the four extruded aluminum alloy frame members and the corresponding number of corner pieces against two of which the shafts 30 are caulked, the shafts 30 are mounted on the movable framework 25.

The cremorn lock 31 is mounted on the movable framework 25 and includes a pair of locking rods 46 having the leading ends guided in guides 50 on the movable framework 25 for projecting from the movable framework 25 to the stationary framework 24 or vice versa, a pair of rod supports 47 mounted on the stationary framework 24 for receiving the leading ends of the locking rods 46, an operation plate 48 rotatably mounted on the cover plate 28 and connected to the locking rods 46 and a crank shaft 49 for rotating the operation plate 48 from outside of the cover plate 28. The cremorne lock is a conventional device.

The cremorne lock 31 can be replaced by a conventional locking device which is commonly employed.

The mounting means 16 each comprises a carrier plate 51 holding the access door 15 and more particularly, the stationary framework 24 thereof on the associated auxiliary beam 14, and a threaded clamping bar 52 mounting the carrier plate 51 on the specific or associated beam . 14 so as to sandwich the access opening defining edge of the ceiling wall 13 between the auxiliary beam 14 and the associated outwardly extending flange 33 of the stationary framework 24.

The carrier plate 51 extends along the inner surface of the associated frame member of the stationary framework 24 and has a plate-like hook 53 at the lower end to be received into the groove 36 and a horizontally bent arm 54 at the upper end, respectively. The arm 54 is formed with a threaded hole (not shown) for threaded engagement with the threaded clamping bar 52. Thus, the carrier plate 51 and threaded clamping bar 52 are preassembled so that the access door 15 can be easily mounted on the auxiliary beams 14.

In the construction of the ceiling structure 10 comprising the above-mentioned components, the wall mouldings are attached to the concrete ceiling wall of a building room in accordance with a predetermined layout by the use of concrete nails, a plurality of wire fasteners are driven into the ceiling slabs in a suitably spaced relationship and wire hangers are hung on the wire fasteners.

Thereafter, a plurality of main beams 11 each comprising a plurality of beam members end to end connected by the end couplings at the opposite ends thereof are bridged in a suitably spaced relationship in one plane between the wall mouldings, the main beams 11 are connected to the wire hangers and secured at the opposite ends thereof to the wall mouldings by set screws.

After the main beams 11 have been bridged and held in position between the wall mouldings in the manner mentioned hereinabove, the cross beams 12 are bridged in a predetermined spaced relationship between the main beams 11 and between the main beams 11 and wall mouldings, respectively, at right angles thereto so as to form a grid shaped ceiling framework, the cross beams 12 are connected to the main beams 11 by the twisted clips and are connected to the wall mouldings by the screws and a plurality of ceiling tiles 21 are in succession connected to the ceiling framework from one corner to the other corners of the ceiling by the cross beams 12 and a plurality of ribbed splines 23 received in the abutting grooves 22 to form the ceiling wall 13.

Especially, in the grids at the other corners of the ceiling, by the use of the cross beams 12 having the notches in the flanges 18 and the closing splines hooked to the cross beams 12, the ceiling tiles 21 can be easily assembled.

After the ceiling structure has been completed in the manner described hereinabove, as the ceiling tiles 21 are in succession positioned and held in position between the main beams 11 and between the main beams 11 and wall mouldings, respectively, the access opening 19 is formed in a predetermined position.

And cross tees which are bridged and connected between the main beams 11 and between the main beams 11 and wall mouldings are employed in a predetermined spaced relationship according to the dimensions of the grids in the ceiling framework and the dimensions of the ceiling tiles 21.

Next, as shown in FIGS. 1 and 2, a pair of auxiliary beams 14 are bridged between the flanges 18 on the opposing main beams 11 so as to ride on the reverse or inner side of the ceiling wall 13 in the access opening 19.

After the auxiliary beams 14 have been disposed in the manner as described hereinabove, the stationary framework 24 without the access door 15 and accordingly, the movable framework 25 is fitted in the access opening 19 and pushed into the access opening until the outwardly extending flanges 33 come into contact with the peripheral edge of the access opening 19 on the surface of the ceiling wall 13 whereupon the stationary framework 24 is temporarily secured to the auxiliary beams 14 by means of the four mounting means 16.

That is, the hooks 53 are fitted in the grooves 36 by sliding the hooks 53 along the frame member webs 32 of the stationary framework 24 on the inner side of the stationary framework 24, the carrier plates 51 are hooked on the stationary framework 24 fitted in the access opening 19, the threaded clamping bars 52 are screwed into and through the threaded holes in the carrier plates 51 until the leading ends of the bars 52 abut against the auxiliary beams 14 and the stationary framework 24 is temporarily secured to the auxiliary beams 14 by the mounting means 16.

After the stationary framework 24 has been temporarily secured to the auxiliary beams 14, the threaded clamping bars 52 are turned in the fastening direction and the access opening defining edge 20 of the ceiling wall 13 is sandwiched between the outwardly extending flanges 33 on the stationary framework 24 and the auxiliary beams 14 to thereby assemble the stationary framework 24 to the ceiling framework.

After the stationary framework 24 has been assembled to the ceiling framework in the manner described hereinabove, the shafts 30 are snapped in the bearings 29 as the movable framework 25 having the cover plate 25 attached thereto is inserted into the opening 26 defined by the stationary framework 24 to assemble the movable framework 25 to the stationary framework 24 for rotation relative to the stationary framework. Thereafter, the movable framework 24 is rotated upwardly to close the opening 26 in the stationary framework 24 and the movable framework 25 is locked in the position by the cremorne lock 31 to maintain the opening 26 in the closed condition whereby the movable framework 25, and accordingly, the cover plate 25 is locked to the stationary framework 24.

The ceiling construction 10 is erected on the ceiling of the building room in the manner as described hereinabove, but the ceiling construction 10 can be constructed in various different manners from the manner described hereinabove depending upon the conditions of the room and in other words, the construction procedure can be varied depending upon the conditions at the job site.

Figure 4:
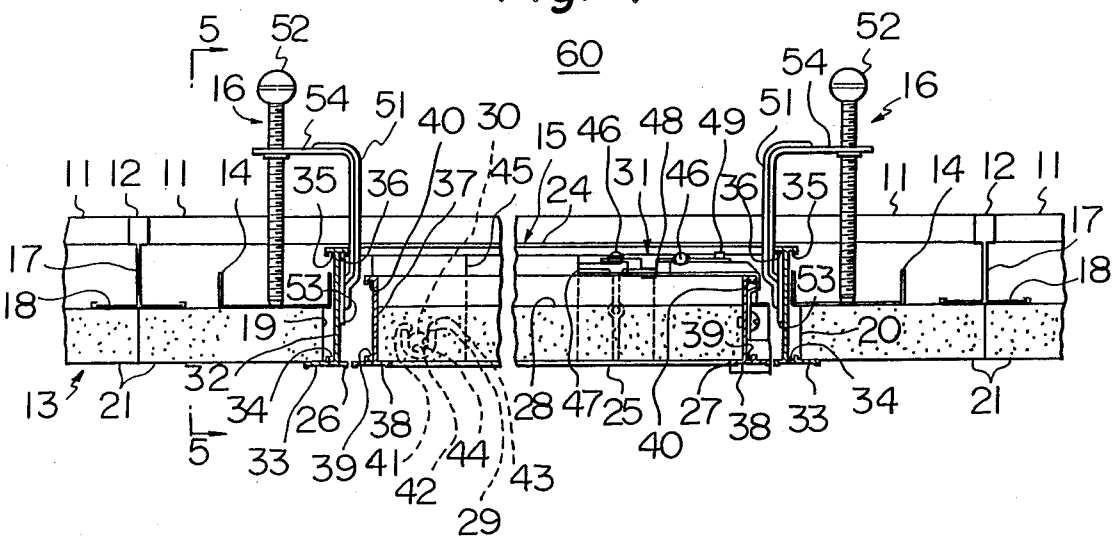
FIG. 4 is similar to FIG. 2, but shows a second embodiment of the ceiling construction of the invention erected by the dry wall construction method as applied to a building.
Figure 5:
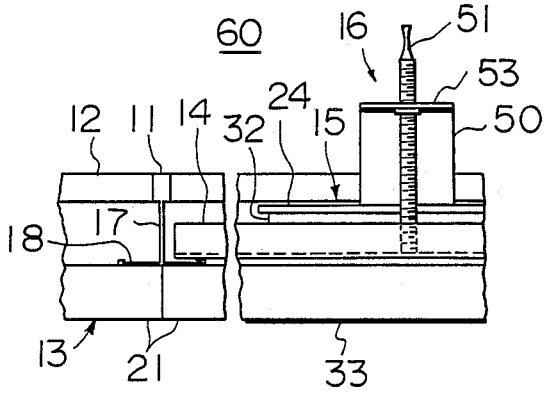
FIG. 5 is a cross-sectional view taken along substantially the line 5—5 of FIG. 4.

FIGS. 4 and 5 fragmentarily show a modified ceiling construction for buildings according to the present invention.

The modified ceiling construction 60 is erected by the dry wall construction method. Different from the foregoing ceiling construction 10 erected by the concealed construction method, the ceiling tiles are fixedly secured to the flanges 18 on the main and cross beams 11, 12 which constitute the ceiling framework by means of nails or screws to form the ceiling wall 13. In the assembling of the ceiling wall 13 to the ceiling wall 13, the pair of auxiliary beams 14 are directly bridged between the flanges of the main beams 11 along the reverse or inner side of the ceiling wall 13.

Since the components of the modified ceiling construction 60 are similar to the corresponding components of the foregoing ceiling construction 10, the components of the modified ceiling construction are denoted by the same numerals as those employed for the corresponding components of the ceiling construction 10 and the description of the corresponding components of the modified ceiling construction will be omitted herein. Furthermore, since the modified ceiling construction 60 is erected by a process substantially similar to that employed in the ceiling construction 10, the description of the construction process of the modified ceiling construction will also be omitted herein.

Figure 7:
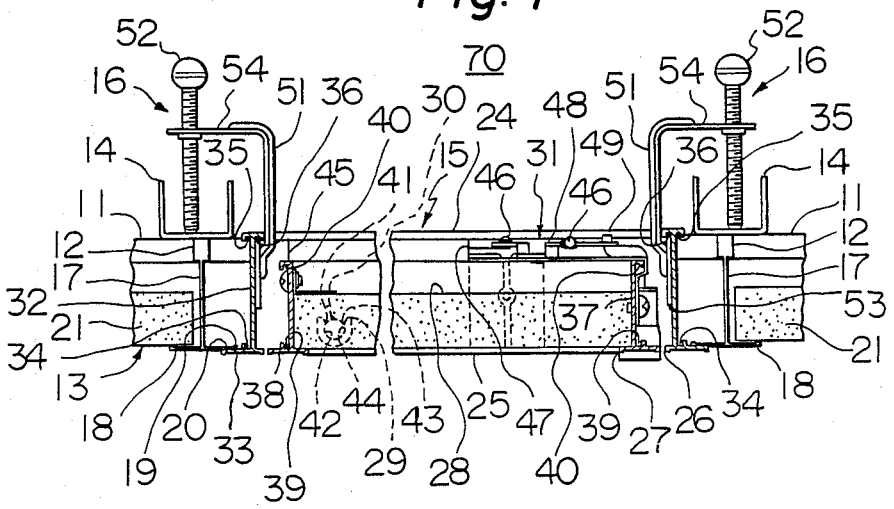
FIG. 7 is a cross-sectional view taken along substantially the line 7—7 of FIG. 6.
Figure 6:
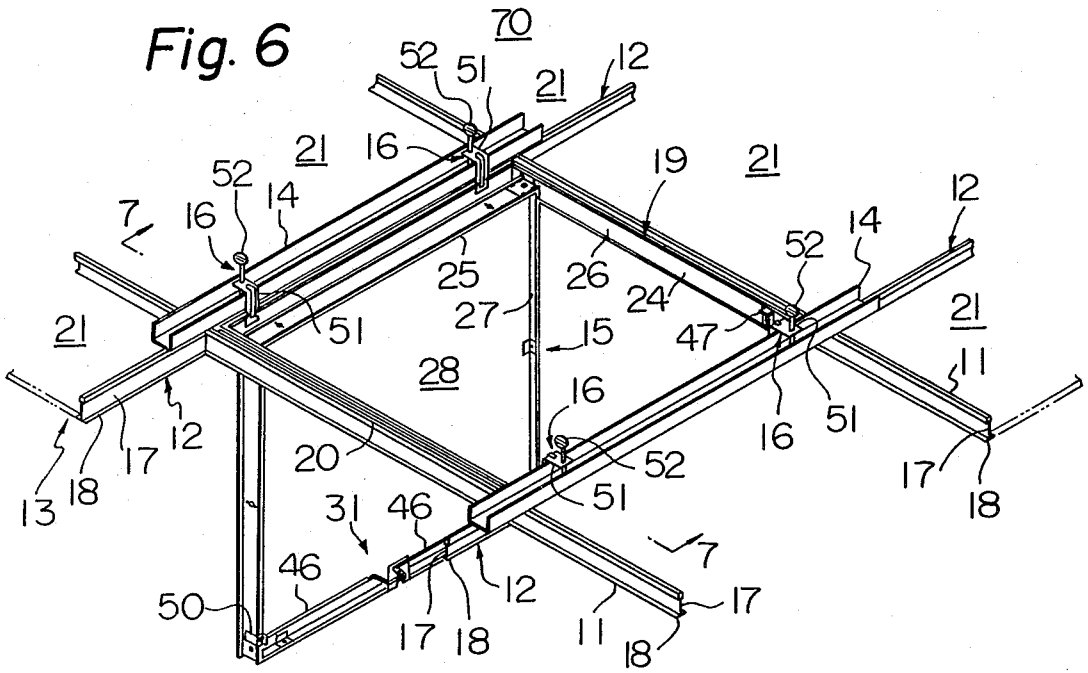
FIG. 6 is a fragmentary perspective view of a modified embodiment of the ceiling construction of the invention as applied to a building.

FIGS. 6 and 7 fragmentarily show a further modified ceiling construction as applied to the ceiling of a building.

The further modified ceiling construction 70 is erected by the exposed construction method. Different from the ceiling construction 10 by the concealed construction method and the ceiling construction 60 by the dry wall construction method, in the ceiling construction 70, the ceiling tiles 21 are laid on the flange 18 on the main and cross beams 11, 12 which constitute the ceiling framework to form the ceiling wall 13 and by assembling the ceiling wall 13 to such a ceiling framework, the pair of auxiliary beams 14 are bridged between the webs 17 of the beam members constituting the main beams 11.

And in the ceiling construction 70, the stationary framework 24 mounting the access door 15 is fixedly secured to the ceiling framework by means of the mounting means 16 in such a manner that the outwardly extending flanges 33 on the stationary framework 24 are hooked on the flanges 18 on the main and cross beams 11, 12.

Since the components of the further modified ceiling construction 70 are similar to the corresponding components of the foregoing ceiling construction 10, the components of the ceiling construction 70 are denoted by the same numerals as those employed for the corresponding components of the ceiling construction 10 and a description of the corresponding components of the ceiling construction 70 will be omitted herein. Furthermore, since the modified ceiling construction is erected by process substantially similar to that employed in the construction of the ceiling structure 10, the description of the construction process of the further modified ceiling construction will also be omitted herein.

Figure 8:
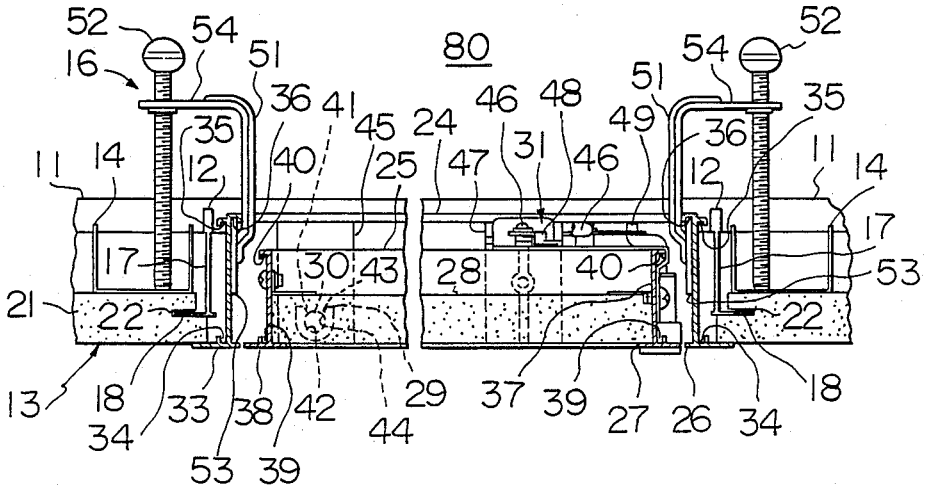
FIGS. 8 and 9 are similar to FIG. 2, but show further modified embodiments of the ceiling construction of the invention as applied to a building.
Figure 9:
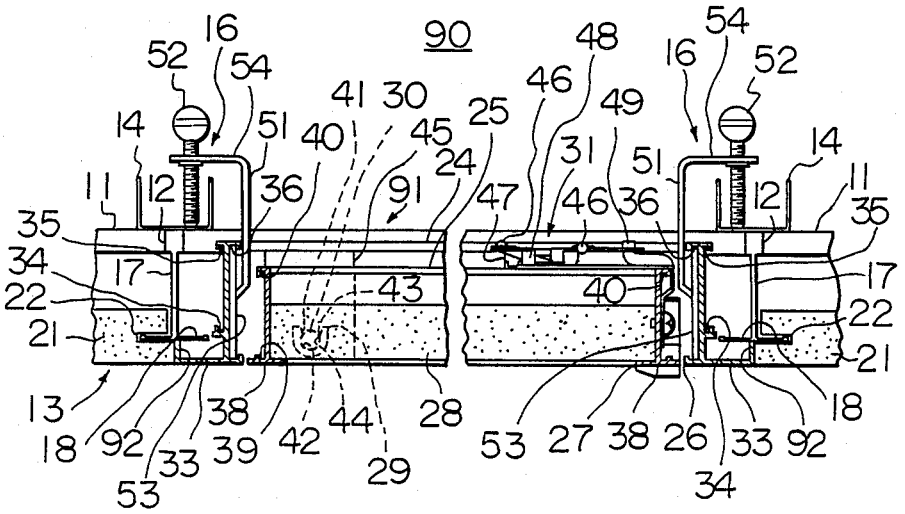

FIGS. 8 and 9 fragmentarily show still a further modified ceiling construction as applied to a building.

The still further modified ceiling construction 80, 90 of FIGS. 8 and 9 is erected by the concealed construction method. In each of the ceiling construction of FIGS. 8 and 9, the access opening 19 in the ceiling framework is defined by a suitably positioned grid or by the pair of opposing main beams 11 and the pair of opposing cross beams 12 bridging the main beams 11 at right angles thereto.

In the ceiling construction 80 of FIG. 8, in the access opening 19, the access door 15 is secured to the ceiling framework by means of the mounting means 16, that is, the flanges 18 on the main and cross beams 11, 12 are cut by metal cutting scissors and the flanges 18 on the cross beams 12 received in the grooves 22 formed in the ceiling tiles 21 are sandwiched between the auxiliary beams 14 and stationary framework 24 from the outer and inner surfaces of the ceiling tiles 21.

The modified ceiling construction 90 of FIG. 9 is fixedly secured to only the ceiling framework with the access door 15 lying on the plane of the upper surface of the ceiling wall 13 and thus, the outwardly extending flanges 33 on the frame members of the stationary framework 24 are bent upwardly at the outer edges of the flanges.

Therefore, the access door 91 is secured to the ceiling framework by the auxiliary beams 14 bridging the webs 17 on the beam members of the main beams 11 and mounting means 16 with the lips 92 of the access door abutting against the flanges 18 on the beam members of the cross beams 12.

Different from the previously proposed and existing prior art ceiling construction for buildings, in the ceiling construction for buildings according to the present invention, the ceiling framework comprises a plurality of main and cross beams bridging opposing wall mouldings and hung from a plurality of hanger wires or hanger rods, the ceiling wall is assembled to the ceiling framework so as to define the access opening in a predetermined position, the pair of auxiliary beams are bridged between the opposing main beams adjacent to each of the opposing cross beams in parallel to the cross beams on the inner side of the ceiling wall in the area of the access opening and the access door is secured to the ceiling framework by means of a plurality of mounting means in the area of the access opening so as to sandwich the peripheral edge of the access door of the ceiling wall and one of the main beam and cross beam between the auxiliary beams and the outwardly extending flanges on the access door. The present invention can be advantageously applied to various ceiling constructions for buildings which are erected by the exposed construction method, concealed construction method or the dry wall construction method. The ceiling construction of the invention has reinforced rigidity and thus, when the access door is opened and closed, the ceiling construction is prevented from warping in the horizontal and vertical directions which may be otherwise caused under the load of the access door. Thus no strain and deflection occur in the ceiling construction to allow the access door to open and close smoothly. Furthermore, the construction of the ceiling structure is simple and can be completed in a shorter period and the ceiling construction has an improved finish.

As clear from the foregoing description of preferred embodiments of the invention referring to the accompanying drawings, it is to be understood that various modifications and changes will easily occur to those having an ordinary knowledge in the art and the invention can be easily replaced by embodiments which satisfy substantially the same objects as those described hereinabove and attain substantially the same effects as those described hereinabove.

What is claimed is:

1. A ceiling construction for buildings comprising:

a plurality of flanged main beams disposed in a predetermined spaced relationship to each other and positioned for bridging wall mouldings opposed and spaced from each other;

a plurality of flanged cross beams connected to said main beams in a predetermined spaced relationship to each other at right angles to the main beams so as to form a ceiling framework;

a ceiling wall having a reverse side thereof above the level of the flanges of said main and cross beams in said ceiling framework and mounted in said ceiling framework, said ceiling wall having an access opening therein in a predetermined position between a pair of spaced opposed main beams and a pair of spaced opposed cross beams extending between said pair of main beams;

a pair of auxiliary beams extending between one of said pairs of beams, extending along the edges of said access opening, and bridging between the flanges of said one of said pairs of beams and riding on the reverse side of the ceiling wall around said access opening;

an access door means positioned in said access opening and having a stationary frame having an outwardly extending flange, a movable frame hingedly connected to said stationary frame, and a cover plate fixedly secured to said movable frame; and a plurality of mounting means engaged between said stationary frame and said auxiliary beams and holding the outwardly extending flange of the stationary frame against lower surface of said ceiling construction and securing said stationary frame to said ceiling framework.

2. A ceiling construction as claimed in claim 1 in which the edges of the flanges of said main and cross beams are embedded in the edges of said ceiling wall in a concealed construction arrangement.

3. A ceiling construction as claimed in claim 1 in which the edges of the flanges of said main and cross beams are engaged around the front side of said ceiling wall in an exposed construction arrangement.

* * * * *